US010471462B2

(12) United States Patent
Diers

(10) Patent No.: US 10,471,462 B2
(45) Date of Patent: Nov. 12, 2019

(54) DEVICE FOR APPLYING SPACKLING PASTE OR CAULKING MATERIALS AND METHODS OF USING THE SAME

(71) Applicant: Timothy Robert Diers, Naples, FL (US)

(72) Inventor: Timothy Robert Diers, Naples, FL (US)

(73) Assignee: ABACOCAY, LLC, Naples, FL (US)

( * ) Notice: Subject to any disclaimer, the term of this patent is extended or adjusted under 35 U.S.C. 154(b) by 0 days.

(21) Appl. No.: 15/905,771

(22) Filed: Feb. 26, 2018

(65) Prior Publication Data

US 2018/0257102 A1 Sep. 13, 2018

Related U.S. Application Data

(60) Provisional application No. 62/555,106, filed on Sep. 7, 2017, provisional application No. 62/470,406, filed on Mar. 13, 2017.

(51) Int. Cl.

| | |
|---|---|
| ***B05C 17/01*** | (2006.01) |
| ***B05C 17/10*** | (2006.01) |
| ***E04F 21/06*** | (2006.01) |
| ***B05C 17/005*** | (2006.01) |
| ***E04F 21/165*** | (2006.01) |

(52) U.S. Cl.

CPC .... *B05C 17/0116* (2013.01); *B05C 17/00576* (2013.01); *B05C 17/00579* (2013.01); *B05C 17/00596* (2013.01); *B05C 17/10* (2013.01); *E04F 21/06* (2013.01); *E04F 21/165* (2013.01); *B05C 17/01* (2013.01)

(58) Field of Classification Search

CPC ..... B05C 17/0116; B05C 17/10; B05C 17/00576

See application file for complete search history.

(56) References Cited

U.S. PATENT DOCUMENTS

| | | | | | |
|---|---|---|---|---|---|
| 3,188,057 | A | * | 6/1965 | Trumbull | B01F 11/0054 222/229 |
| 4,081,112 | A | | 3/1978 | Chang | |
| 4,264,021 | A | | 4/1981 | Davis | |
| 4,406,107 | A | | 9/1983 | Schoonbeck | |
| 4,432,473 | A | | 2/1984 | MacEwen | |
| 4,907,727 | A | | 3/1990 | Ernst et al. | |
| 5,097,987 | A | | 3/1992 | Liberatore | |
| 5,408,919 | A | * | 4/1995 | Hutzler | A47J 37/106 222/79 |
| 5,595,327 | A | | 1/1997 | Dentler et al. | |
| 5,692,642 | A | * | 12/1997 | Brattesani | B05C 17/01 221/199 |

(Continued)

FOREIGN PATENT DOCUMENTS

| | | | | |
|---|---|---|---|---|
| WO | WO 02/00356 | * | 1/2002 | B05C 17/0116 |
| WO | WO 2005/037128 | * | 4/2005 | B05C 17/0116 |

OTHER PUBLICATIONS

Amazon.com search results for "Red Devil 0658 Patch-A-Wall Spackling Paste" and related items (46 pages).

*Primary Examiner* — J C Jacyna

(74) *Attorney, Agent, or Firm* — John E. Boyd; FisherBroyles LLP

(57) ABSTRACT

Spackling or caulking devices using cartridges for applying spackling or caulking to one or more surfaces or objects and methods of using the same.

28 Claims, 6 Drawing Sheets

(56) References Cited

U.S. PATENT DOCUMENTS

| | | | | |
|---|---|---|---|---|
| 5,875,920 | A * | 3/1999 | Parent | B05C 17/01 222/1 |
| 5,988,452 | A * | 11/1999 | Dent | A61M 5/204 222/309 |
| 6,554,161 | B2 * | 4/2003 | Main | A61D 7/00 222/287 |
| 7,121,054 | B2 | 10/2006 | Shock | |
| 8,505,784 | B2 * | 8/2013 | Trow | A61D 7/00 222/323 |
| 8,650,829 | B2 | 2/2014 | Clarke et al. | |
| 8,776,470 | B2 | 7/2014 | Karam et al. | |
| 8,991,128 | B2 | 3/2015 | James | |
| 2005/0023301 | A1 | 2/2005 | Rumrill et al. | |
| 2006/0091157 | A1 * | 5/2006 | Nomula | B05C 17/01 222/326 |
| 2014/0197204 | A1 * | 7/2014 | Bublewitz | B05C 17/00513 222/145.5 |
| 2014/0260046 | A1 | 9/2014 | Baynham | |
| 2016/0107187 | A1 * | 4/2016 | Beebe | B05C 17/014 222/1 |
| 2016/0143681 | A1 * | 5/2016 | Greiner | A61B 17/8819 606/94 |
| 2016/0243581 | A1 * | 8/2016 | Clemens | B05C 17/00583 |

* cited by examiner

DEVICE FOR APPLYING SPACKLING PASTE OR CAULKING MATERIALS AND METHODS OF USING THE SAME

RELATED APPLICATIONS

This application claims the benefit of and priority to U.S. Provisional Application No. 62/555,106, filed Sep. 7, 2017 and U.S. Provisional Application No. 62/470,406, filed Mar. 13, 2017 each entitled "Device for Applying Spackling Paste or Caulking Materials, Methods of Using the Same", which are hereby incorporated by reference in its entirety.

TECHNICAL FIELD

The invention generally relates to devices, cartridges and methods of applying spackling or caulking.

BACKGROUND

Several publications are referenced in this application. The cited references describe the state of the art to which this invention pertains and are hereby incorporated by reference, particularly the systems and methods set forth in the detailed description and figures of each reference.

Caulking materials and spackling paste are often used during commercial and residential construction, but also for repairs and renovations. For the dispensing of viscous fluids, such as two-part epoxy components, caulking materials, spackling paste and the like, the prior art includes dispensing devices which typically include a metal frame for holding a cartridge tube. A pair of pistons and corresponding parallel piston rods are carried by means of the frame. A third push rod, disposed parallel to the piston rods, is attached to the piston rods at one end by means of a connecting plate. Axial forces applied to the push rod are transferred to the piston rods through means of the connecting plate. As the respective piston rods and pistons are moved forward into the corresponding cartridge and towards the nozzle, the pistons make contact with the cartridge plungers which, in turn, force the viscous fluids of the cartridge assembly out of the nozzle.

SUMMARY OF INVENTION

The invention relates to improved devices adapted to apply spackling paste, caulking material and other viscous materials.

One aspect of the invention relates to a spackling or caulking device comprising:

a) a back handle having a top end and a bottom end;

b) a front handle having a top end and a bottom end, wherein the front handle and the back handle are pivotally connected at the bottom end of the back handle and the bottom end of the front handle;

c) an elongated plunger slidably extending through an accommodating bore at the top end of the front handle and having a tail end ending at an accommodating seat at the top end of the back handle and configured (e.g., by shape, size, material, etc.) to allow the top end of the front handle to slidably move relative to the top end of the back handle; and d) a hollow cylindrical cartridge having an open rear end reversibly secured within the bore and a cartridge front end having a nozzle and being spaced away from the open rear end, wherein the hollow cartridge comprises spackling paste or caulking material.

Another aspect of the invention relates to cartridge(s) for use in the device of the invention.

Another aspect of the invention relates to kits comprising, in one or more containers, one or more components of the device and/or one or more cartridges.

Yet another aspect relates to methods of using the device of the invention comprising applying the spackling paste or caulking material to a surface and replacing the cartridge with a replacement cartridge.

The foregoing has outlined some of the aspects of the present invention. These aspects should be construed strictly as illustrative of some of the more prominent features and applications of the invention, rather than as limitations on the invention. Many other beneficial results can be obtained by modifying the embodiments within the scope of the invention. Accordingly, for other objects and a full understanding of the invention, refer to the summary of the invention, the detailed description describing the preferred embodiment in addition to the scope of the invention defined by the claims and the accompanying drawings. The unique features characteristic of this invention and operation will be understood more easily with the description and drawings. It is to be understood that the drawings are for illustration and description only and do not define the limits of the invention.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF PREFERRED EMBODIMENTS

In the following description, for purposes of explanation, specific details are set forth in order to provide a thorough understanding of different aspects of the present invention. It will be evident, however, to one skilled in the art that the present invention as defined by the claims may include some or all of the features or embodiments herein described and may further include obvious modifications and equivalents of the features and concepts described herein.

One aspect of the invention relates to improved spackling or caulking devices for applying spackling or caulking to one or more surfaces or objects. The device of the invention includes innovative designs and features providing advantages to users including use with a single hand when using the device and/or the use of smaller volumes of spackling/caulking materials stored in the device for application to reduce waste.

Moreover, according to preferred embodiments, the cartridge size can be smaller compared to conventional caulking tubes, for example, allowing for less pressure needed to dispense and apply the material. As a result, the device can be comprised of plastic components versus metal components reducing cost, weight and wear/rust.

One embodiment of the invention relates to a spackling device comprising:

a) a back handle having a top end and a bottom end;

b) a front handle having a top end and a bottom end, wherein the front handle and the back handle are pivotally connected at the bottom end of the back handle and the bottom end of the front handle; an elongated plunger slidably extending through an accommodating bore at the top end of the front handle and having a tail end ending at an accommodating seat at the top end of the back handle and configured (e.g., by shape, size, material, etc.) to allow the top end of the front handle to slidably move relative to the top end of the back handle; and c) a hollow cylindrical cartridge having an open rear end reversibly secured within the bore and a cartridge front end having a nozzle and being spaced away from the open rear end, wherein the hollow cartridge comprises spackling paste or caulking material.

According to preferred embodiments the device is configured (by size and shape) and held similar to a gun or pistol with the back handle being the grip, the front handle being the trigger and the "barrel" containing the piston and cartridge containing the viscous material being applied. The front and back handles are squeezed together to dispense the material from the cartridge. Preferably, the innovative design of the device allows many users to easily use the device with a single hand allowing for more efficient application of the spackling paste, caulking materials and other viscous materials.

Figure 1A:
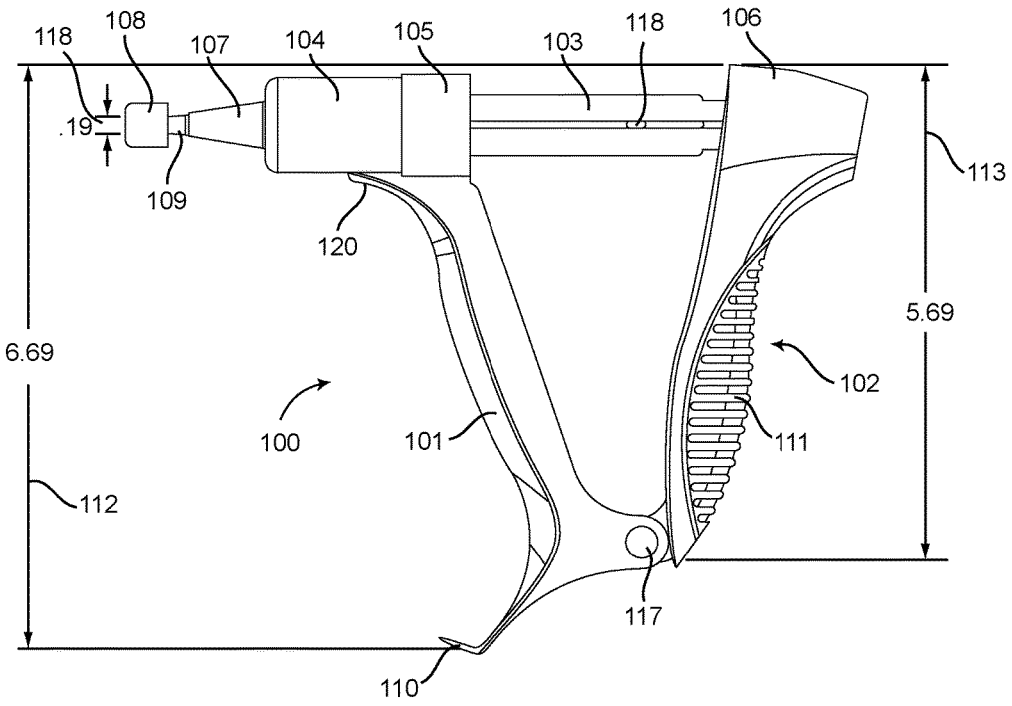
FIG. 1A is a side view of a spackling/caulking device according to one embodiment of the invention.

FIG. 1A shows a device (100) according to one embodiment of the invention including front handle (101) and back handle (102) pivotally connected at hinge (117) and the plunger (103) positioned with one "rear" end of plunger (103) positioned (preferably reversibly locked) into seat (106) at the top of back handle (102) and the opposite "front" end of plunger (103) slidably set within bore 105 (or opening) at the top of front handle (101).

According to preferred embodiments, plunger (103) is connected to back handle (102) with a snap in place application (preferably performed during final assembly of device) to reduce the risk of loosening during use. In contrast, when plunger (103) is connected using a turn to lock in place application there is a risk the plunger (103) will become loose during use.

Cartridge (104) is shown having nozzle (107) with twist-off cap (108) at the front end or tip (109) of the cartridge (104) and with the rear end of the cartridge (104) positioned within and/or through bore (105) at the top of front handle (101).

Twist-off cap (108) seals cartridge (104) to protects the materials contained within the cartridge to be ready for use. After twisting off or otherwise removing twist-off cap (108), the materials can be dispensed or applied. However, as is known, most spackling and/or caulking materials harden after a period of time thus using smaller cartridges allows users to use the device for smaller projects without wasting the spackling/caulking materials. Preferably, the tip is designed to be snapped off.

Thus, pulling front handle (101) towards back handle (102) results in plunger (103) driving into the back of cartridge (104) allows the materials within cartridge (104) to be pushed out nozzle (107) after the twist-off cap (108) is removed. According to preferred embodiments, cartridge (104) includes one or more vents (418) along the inner wall of cartridge (104) to avoid air becoming trapped and a vapor lock preventing the plunger (103) from pushing the compounds through the cartridge (104).

Figure 1B:
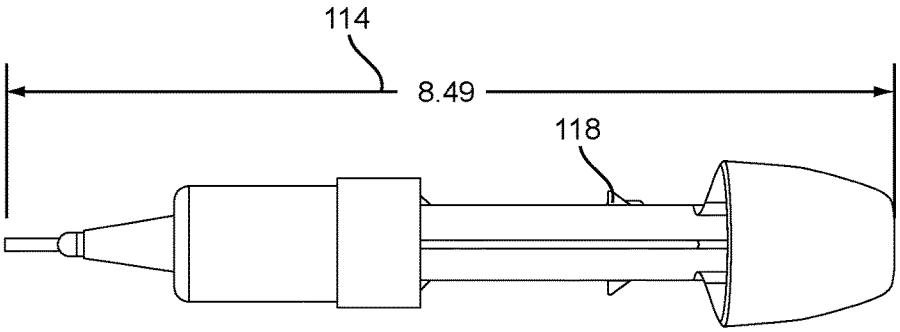
FIG. 1B is a top view of a spackling/caulking device of FIG. 1A.
Figure 1C:
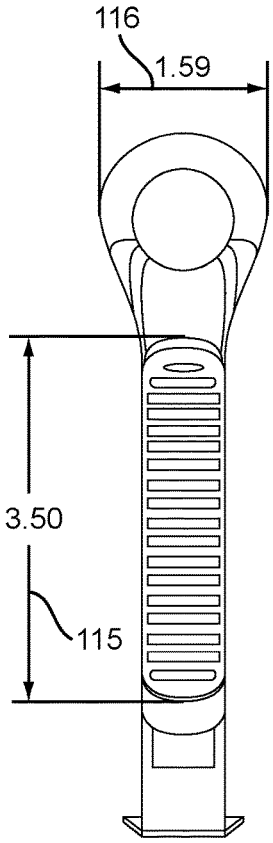
FIG. 1C is a rear view of a spackling/caulking device of FIG. 1A.
Figure 1D:
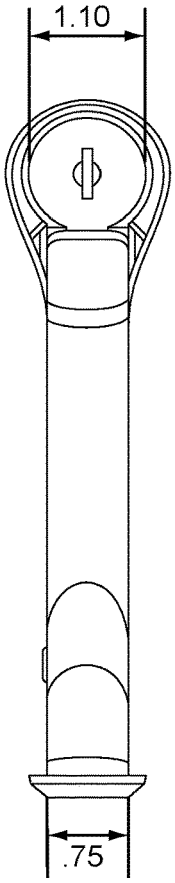
FIG. 1D is a front view of a spackling/caulking device of FIG. 1A.
Figure 1E:
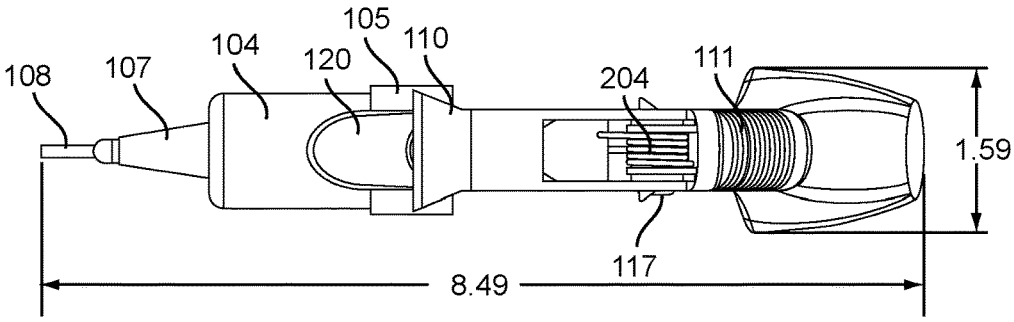
FIG. 1E is a bottom view of a spackling/caulking device of FIG. 1A

As can be seen from FIG. 1A, a user can dispense the materials from the cartridge using one hand to grip and squeeze back front handle (101) making the application of spackling/caulking materials or other viscous materials easier and more efficient. FIG. 1B is a top view of a spackling/caulking device of FIG. 1A. FIG. 1C is a rear view of a spackling/caulking device of FIG. 1A. FIG. 1D is a front view of a spackling/caulking device of FIG. 1A. FIG. 1E is a bottom view of a spackling/caulking device of FIG. 1A.

Figure 2:
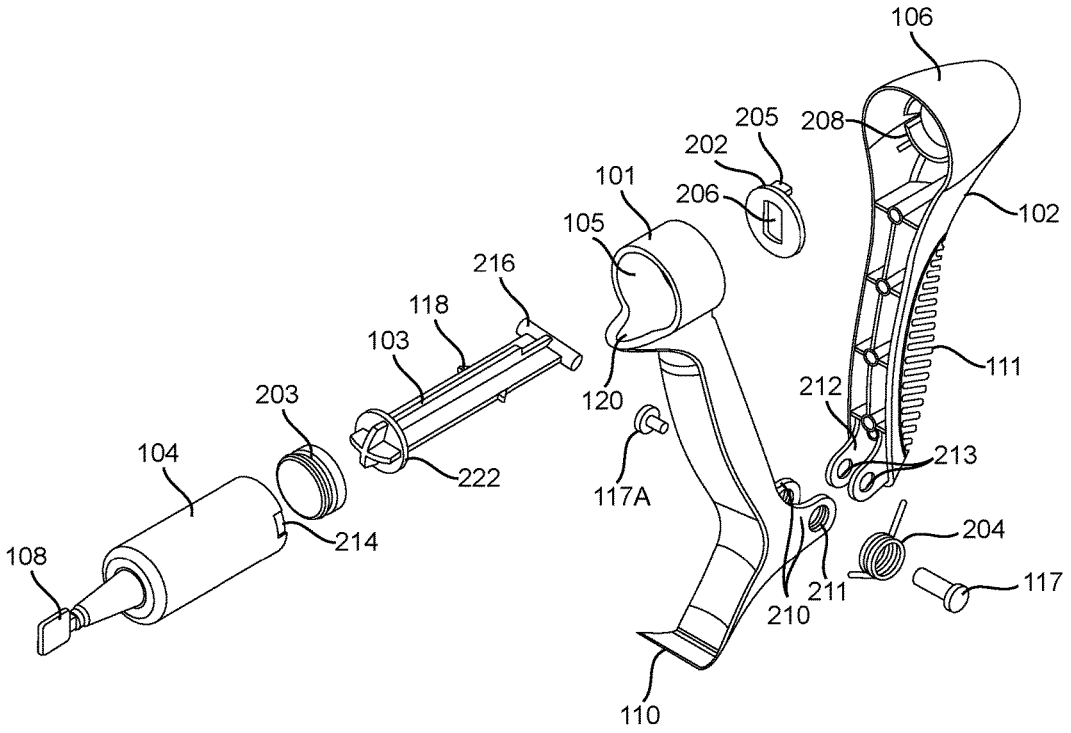
FIG. 2 is an exploded view of a spackling/caulking device according to one embodiment of the invention.

FIG. 2 shows an exploded view of the device of FIG. 1.

According to one preferred embodiment, the device further comprises a front facing spatula (110) at the bottom end of the front handle (101). Preferably, the spatula (110) is integral to the front handle (101) and is shaped similar as shown in FIG. 1. More preferably, the entire front handle (101) including spatula (110) and opening (105) is formed form a single molded plastic component. Even more preferably, the applicator device (100) is made from three injection molded parts (e.g., front handle (101), back handle (102) and plunger (103)) so only the rivet and spring require being added before using the device with cartridge (104). Preferably, the front handle (101) and back handle (102) have edges that are rounded out to make it less sharp and provide a smoother finish for the user when handling.

Preferably spatula (110) comprises a planar surface with a leading edge as shown in FIG. 1A. According to one preferred embodiment, spatula (110) includes one or more ribs (not shown) to create more rigidness and stability.

According to another preferred embodiment, the front handle (101) comprises a curved front side and straight back side as shown in FIG. 1A. Preferably, the front handle (101) is an integral molded component made from plastic. Preferably, the back handle (102) is an integral molded component made from plastic. Preferably, the plunger (103) is an integral molded component made from plastic.

Preferably, opening (105) includes a lip (120) to support and/or align and/or guide cartridge (104) when inserted into or within opening (105). Preferably, the lip (120) supports the cartridge (104) and/or helps guide and/or align the cartridge when being installed in the device (100) and during use. Thus, to preferred embodiments, the accommodating bore (105) at the top end of front handle (101) comprises a supporting lip (120) extending from the accommodating bore to support and guide the plunger (103).

Preferably, the front handle has a length and/or height (112) ranging from 4 to 8 inches, preferably 5 to 7 inches. This allows the device to be held comfortably in a single hand (e.g., designed to fit the 80th percentile of hand size). According to preferred embodiments, front handle (101) includes a grip texture (not shown) like grip texture (111) on back handle (102).

According to another preferred embodiment, the front handle is pivotally connected to the back handle by a hinge axle pin (117) passed through first accommodating pin bores (211) at the bottom end of the front handle (101) and second accommodating pin bores (213) at the bottom end of the back handle (102).

According to another preferred embodiment, the device further comprises a spring (204) urging the front handle (101) and the back handle (102) to pivot to an open position versus the squeezed position(s). Preferably, the spring is a torsion spring (204) having a center opening with the hinge axle pin (117) passed through, the torsion spring (204) urging front handle (101) and the back handle (102) to pivot to an open position. Preferably, spring (204) is stainless steel.

According to another preferred embodiment, the hinge axle pin (117), spring (204) and device (100) are configured and/or adapted (e.g., by size, shape, material) such that when the front handle (101) is released, the pressure applied by the plunger (103) to the cartridge (104) is reduced, preferably reversed, resulting in stopping the continued disbursement of the spackling paste, caulking material or other viscous material from the tip of the cartridge (104), resulting in less waste and less mess. Preferably, the plunger (103) backs off cartridge (104) forming a vacuum effect on the material within the cartridge (104) pulling the material back from the nozzle opening thereby preferably eliminating any waste or mess.

Preferably, the bottom end of front handle (101) and the bottom end of the back handle (102) each comprise a pair of parallel spaced fingers (210 and 212) having the first accommodating pin bore (211) or second accommodating pin bore (213) for passing through the hinge pin (117) and preferably also accommodating spring (204).

The device includes a back handle that pivots with the front handle. Preferably, the back handle (102) comprises a backside including a grip texture (111). Preferably, the back handle has a length or height (113) between 3-7 inches, preferably between 5-6 inches.

According to another preferred embodiment, the back handle (102) comprises a pair of parallel spaced fingers (212) having the accommodating pin bore(s) (213) for passing through the hinge pin (117) to connect to hinge pin nut (117A). Preferably, the accommodating pin bore(s) (213) of the back handle (102) can be aligned with the accommodating pin bore(s) (211) of the front handle (101).

According to preferred embodiments, hinge pin (117) is a single piece compression rivet not requiring nut (117A) further simplifying the construction of the device. Preferably, hinge pin (117) is a single piece tubular rivet that is set, for example, with a pneumatic press.

According to preferred embodiments, the device comprises an elongated plunger adapted to push the material out of the cartridge.

According to one preferred embodiment, the plunger has a length ranging from 3 to 6 inches, preferably 3.5 to 4 inches.

According to another preferred embodiment, the plunger comprises an X-shaped cross-section between the rear end and front end of the plunger as shown in FIG. 1.

According to another preferred embodiment, the device further comprises a plunger end cap (202) for reversibly securing the rear end of the plunger to the accommodating seat (106).

According to another preferred embodiment, the plunger comprises a plunger locking mechanism or structure (216) at the tail end for locking with corresponding locking opening (206) within plunger end cap (202). Preferably, plunger end cap (202) includes a locking tab (205) the allows for reversibly locking with locking structure (208) within the accommodating seat (106).

According to another preferred embodiment, plunger comprises front end comprising a plunger cap (222) adapted to push plunger seal (103). Preferably, the plunger cap (222) has a diameter greater than the diameter of plunger and less then the outer diameter of the cylindrical cartridge and adapted to push into an opening in the rear of the cylindrical cartridge (104).

According to still further preferred embodiments, plunger cap (222) is omitted and the plunger (103) tail end instead snaps directly into a locking structure (208) within the accommodating seat (106).

Another aspect of the invention relates to improved cartridges containing spackling paste, caulking material or other viscous materials used for various applications.

Another embodiment of the invention relates to a cartridge comprising a hollow cylindrical cartridge (104) having an open rear end sealed with a plunger seal (203) and a cartridge front end having a nozzle (107) and being spaced away from the open rear end, wherein the hollow cartridge comprises spackling paste or caulking material.

Preferably, plunger seal (203) is made of rubber or other flexible material and fits into the back of the cartridge to seal the cartridge and protect the materials within from hardening and leaking. According to preferred embodiments, plunger seal (203) is made of a plastic resin.

Preferably, the hollow cylindrical cartridge comprises between 1 and 100 ml of the spackling paste or caulking material or other viscous material, more preferably between 10-30 ml.

Advantageously, since the cartridge size can be configured smaller compared to conventional caulking or spackling tubes, this reduces the waste from unused materials since users can use replacement small cartridges until the project is completed versus opening a single new large conventional caulking tube resulting large amounts of unused material left in the tube after the small project is completed. Many users of caulking devices have been frustrated by partially used tubes with substantial materials left in the tube to harden and become unusable and often sent to landfills.

According to one preferred embodiment, the cartridge is adapted to be disposable and/or replaceable and/or interchangeable and/or re-filled to be reused. Alternatively, the cartridge is adapted to allow a user to refill the cartridge for additional use(s). Preferably, the method of re-using a cartridge includes removing the spent cartridge from the device, re-filling the cartridge with caulking or spackling material, and re-inserting the cartridge into the device for use. Preferably, one end of cartridge (404) is adapted to be opened (e.g., unscrewing an end piece or cap) to access the interior of cartridge (404) to remove and/or clean out unused material. Preferably, the plunger seal (203) includes a tab facing outward (towards the rear of cartridge and towards plunger) allowing the plunger seal to be removed after the cartridge is depleted of material so the cartridge can be refilled and capped with a new plunger seal.

Alternatively, the plunger seal (203) includes a self-sealing opening to allow replacement material to be injected into the cartridge and re-sealed so the cartridge can be re-used many times. This provides many advantages compared to disposable components used in prior single-use caulking devices.

According to another preferred embodiment, the cartridge has a cylindrically shaped tubular body.

Preferably, the hollow cylindrical cartridge comprises a cylindrical body portion and a tapering nozzle portion with the nozzle.

Preferably, the cylindrical body portion has a length ranging from 2 to 4.5 inches, preferably 2.15 to 3.5 inches.

Preferably, the cylindrical body portion has a diameter ranging from 0.5 to 1.5 inches, preferably 0.85 to 1.15 inches.

Preferably, the tapering nozzle portion has a length ranging from 0.75 to 2.25 inches, preferably 1 to 1.7 inches.

Preferably, the nozzle has a dispensing opening having a diameter ranging from 2 to 8 mm, preferably 2.54 to 6 mm. Preferably, the side-walls of the tubular body have a thickness ranging from 0.03 to 0.2 inches, more preferably 0.05 to 0.1 inches.

Figure 3A:
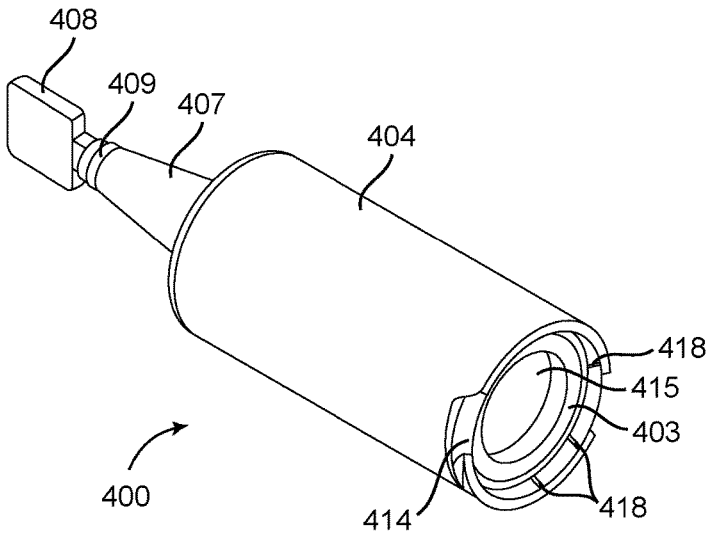
FIG. 3A is a rear side view of a cartridge according to one embodiment of the invention.
Figure 3B:
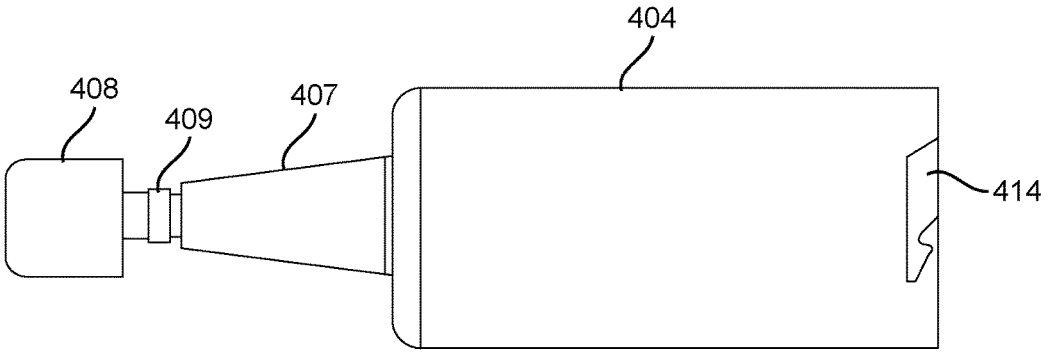
FIG. 3B is a side view of the cartridge of FIG. 3A.
Figure 3C:
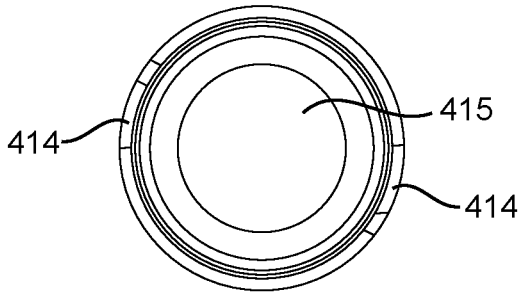
FIG. 3C is a rear view of the cartridge of FIG. 3A.
Figure 3D:
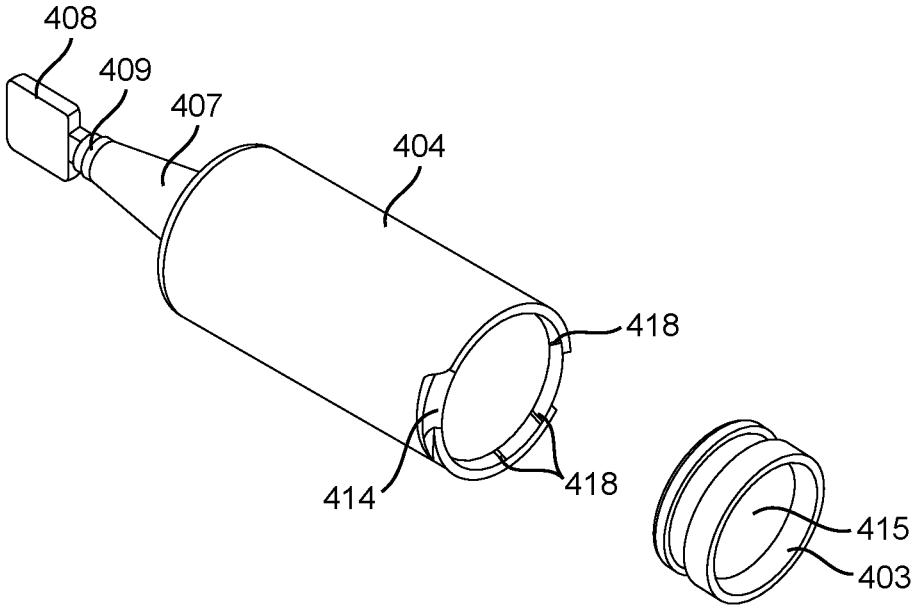
FIG. 3D is an exploded view of the cartridge of FIG. 3A.

FIG. 3A shows "ready-to-use" cartridge unit (400) comprising cylindrical cartridge (404) including nozzle (407) and twist-off (408) and opening with seal (403).

According to one preferred embodiment, the hollow cylindrical cartridge (404) comprises at least one indentation (414) on the outer surface of the hollow cylindrical cartridge and adapted to hold the hollow cylindrical cartridge in place within the accommodating bore (105) at the top end of the front handle (101) shown in FIG. 1.

Preferably, the cylindrical cartridge comprises two or more indentations (414) along the rear outer edge to allow the cartridge to twist into (and lock in place) into the seat. The indentations (214) are preferably configured (e.g., by shape, location, size) to allow the cartridge (400) to twist into (and lock in place) into the opening (105) at the top of front handle (101). Preferably the cartridge is reversibly locked into opening (105) to prevent plunger (103) from pushing the entire cartridge (104) out of the device. That is, the cartridge is adapted to be held in place by indentations or the like which reversibly lock with corresponding locking structures on or within opening (105).

According to one alternative preferred embodiment, the hollow cylindrical cartridge (404) comprises at least one flange or tab extending outwardly on the outer surface of the hollow cylindrical cartridge and adapted to hold the hollow cylindrical cartridge in place within the accommodating bore (105) at the top end of the front handle.

Preferably, the device further comprises a plunger seal (403) slidably fitted within the open rear of the hollow cylindrical cylinder (404) and configured (e.g., by shape, configuration, size, material, etc.) to be pushed within the hollow cylindrical cartridge to force the spackling paste or caulking material out through the nozzle (407).

According to one preferred embodiment, the cartridge includes a rubber stopper or seal (403), preferably inserted during assembly, at the end of the cartridge that is inserted into the cartridge in order to keep the compound (e.g., caulk or spackling paste or caulking material) from leaking out of the cartridge as the injector is pushed forward. The stopper is preferably also adapted to protect the integrity of the compounds.

Preferably, the seal (403) includes recess (415) to accommodate the plunger cap (222) shown in FIG. 2. Preferably, the circumference of the recess (415) is substantially the same size or larger than the circumference of plunger cap (222). Preferably, the cartridge includes a venting system including one or more vents (418) along the inner surface or inner wall of the cylinder (400) to reduce air being trapped and vapor lock preventing the plunger from pushing the materials.

According to one preferred embodiment, the nozzle (107) tapers to a dispensing opening sealed with a break-off tip (108) adapted to be broken off to open the nozzle.

According to another preferred embodiment, the hollow cylindrical cartridge comprises between 10 and 35 ml of the spackling paste or caulking material.

Preferably, when caulking material is used in the cartridge, the nozzle (107) opening will be cut at approximately a 45-degree angle in order for the more viscous caulking material to be more easily dispersed to caulk along a linear line. According to one preferred embodiment, the nozzle (107) has a blunt tip configuration (e.g., 90 degree/vertical cut tip). According to another preferred embodiment, the nozzle (107) has a tip cut at 22.5 degrees (e.g., for use with caulking materials).

The components of the device, excluding the spackling/caulking material, can be made from a variety of materials, preferably plastic, metal or combinations thereof. However, as a result of the smaller cartridges and material volumes used, the components of the devices can be formed using lighter, less expensive and/or more durable components. For example, plastic materials can be used instead of metal reducing the risk of corrosion and/or rust.

According to one preferred embodiment, the front handle is made of plastic.

According to another preferred embodiment, the back handle is made of plastic.

According to another preferred embodiment, the plunger is made of plastic.

According to another preferred embodiment, the cartridge is made of plastic.

Another aspect of the invention relates to devices containing two or more cartridges and/or cartridges with two or more compartments applying different materials from the same device. According to one preferred embodiment, the device comprises a revolving cylinder with different chambers for different materials and can be rotated into different positions to dispense one material at a time. According to another embodiment, there a carrier for different cartridges that allow the cartridges to be easier rotated or otherwise positioned to an individual cartridge is aligned with the plunger for dispensing.

Another aspect of the invention relates to kits comprising, in one or more containers, two or more of the components of the device(s) described above.

One embodiment of the invention relates to kits comprising, in one or more containers, two or more of the filled or charged cartridges described above, preferably three or more.

Another embodiment of the invention relates to kits comprising, in one or more containers, a filled or charged cartridge and a device as described above, preferably two or more cartridges.

Preferably, the kits further comprise written instructions for inserting a new cartridge and removing the used or empty cartridge and using the device.

Another aspect of the invention relates to a method of using the above-described spackling/caulking devices, comprising pulling the top end of front handle towards the top end of the back handle to drive the plunger into the hollow cylindrical cartridge dispensing the spackling paste or caulking material through the nozzle.

According to one embodiment, the method further comprises replacing the hollow cylindrical cartridge with a replacement cylindrical cartridge after the spackling paste or caulking material is fully dispensed.

According to another embodiment, the method further comprises recharging the hollow cylindrical cartridge after the spackling paste or caulking material is fully dispensed with replacement spackling paste or caulking material.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

The scope of the present devices, systems and methods, etc., includes both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a step plus function relationship unless the word "step" is specifically recited in a claim, and are to be interpreted as indicating a "step plus function" relationship where the word "step" is specifically recited in a claim.

It is understood that the embodiments described herein are for the purpose of elucidation and should not be considered limiting the subject matter of the disclosure. Various modifications, uses, substitutions, combinations, improvements, methods of productions without departing from the scope or spirit of the present invention would be evident to a person skilled in the art.

The invention claimed is:

1. A device for applying spackling or caulking comprising:

a) a back handle having a top end and a bottom end;

b) a front handle having a top end and a bottom end, wherein said front handle and said back handle are pivotally connected at said bottom end of said back handle and said bottom end of said front handle;

c) an elongated plunger slidably extending through an accommodating bore at said top end of said front handle and having a tail end ending at an accommodating seat at said top end of said back handle and configured to allow said top end of said front handle to slidably move relative to said top end of said back handle; and d) a hollow cylindrical cartridge having an open rear end reversibly secured within said bore and a cartridge front end having a nozzle and being spaced away from said open rear end, wherein said hollow cartridge comprises spackling paste or caulking material, wherein the device further comprises a front facing spatula at said bottom end of said front handle.

2. The device of claim 1, wherein the front handle comprising the accommodating bore is an integral molded component made from plastic.

3. The device of claim 1, wherein said spatula is integral to said front handle.

4. The device of claim 1, wherein said front handle comprises a curved front side and straight back side.

5. The device of claim 1, wherein said accommodating bore at said top end of said front handle comprises a supporting lip extending from said accommodating bore to support and guide said cartridge.

6. The device of claim 1, wherein said front handle has a length ranging from 4 to 8 inches.

7. The device of claim 1, wherein said front handle is pivotally connected to said back handle by a hinge axle pin passed through a first accommodating pin bore at said bottom end of said front handle and a second accommodating pin bore at said bottom end of said back handle.

8. The device of claim 7, further comprising a torsion spring having a center opening with said hinge axle pin passed through, said torsion spring urging said front handle and said back handle to pivot to an open position.

9. The device of claim 7, wherein the bottom end of said front handle and the bottom end of said back handle each comprise a pair of parallel spaced fingers having said first accommodating pin bore or second accommodating pin bore for passing through said hinge pin.

10. The device of claim 1, wherein said back handle comprises a back side including a grip texture.

11. The device of claim 1, wherein said back handle has a length between 5-6 inches.

12. The device of claim 1, wherein said hollow cylindrical cartridge comprises at least one flange extending outwardly on the outer surface of said hollow cylindrical cartridge and adapted to hold said hollow cylindrical cartridge in place within said accommodating bore at said top end of said front handle.

13. The device of claim 1, further comprising a plunger seal slidably fitted within said open rear of said hollow cylindrical cylinder and configured to be pushed within said hollow cylindrical cartridge to force the spackling paste or caulking material out through said nozzle.

14. The device of claim 1, wherein said hollow cylindrical cartridge comprises a cylindrical body portion and a tapering nozzle portion with said nozzle.

15. The device of claim 14, wherein said cylindrical body portion has a length ranging from 2 to 4 inches.

16. The device of claim 14, wherein said cylindrical body portion has a diameter ranging from 0.5 to 1.5 inches.

17. The device of claim 14, wherein said tapering nozzle portion has a length ranging from 0.75 to 2.25 inches.

18. The device of claim 1, wherein said nozzle has a dispensing opening having a diameter ranging from 2 to 8 mm.

19. The device of claim 1, wherein said nozzle tapers to a dispensing opening sealed with a break-off tip adapted to be broken off to open the nozzle.

20. The device of claim 1, wherein said hollow cylindrical cartridge comprises between 10 and 35 ml of said spackling paste or caulking material.

21. The device of claim 1, wherein said plunger has a length ranging from 3 to 6 inches.

22. The device of claim 1, wherein said plunger comprises an X-shaped cross-section between the rear end and front end of said plunger.

23. The device of claim 1, wherein said plunger comprises a plunger locking mechanism at said tail end for locking with said accommodating seat.

24. The device of claim 1, wherein said plunger comprises front end comprising a plunger cap having a diameter greater than the diameter of said plunger and adapted to push into said hollow cylindrical cartridge.

25. The device of claim 1, further comprising a plunger end cap for reversibly securing said rear end of said plunger to said accommodating seat.

26. A method of using the device of claim 1, comprising pulling the top end of front handle towards the top end of said back handle to drive the plunger into the hollow cylindrical cartridge dispensing the spackling paste or caulking material through the nozzle.

27. The method of claim 26, further comprising replacing the hollow cylindrical cartridge with a replacement cylindrical cartridge after the spackling paste or caulking material is fully dispensed.

28. The method of claim 26, further comprising recharging the hollow cylindrical cartridge after the spackling paste or caulking material is fully dispensed with replacement spackling paste or caulking material.

* * * * *